US008573021B2

(12) United States Patent
Ewolski et al.

(10) Patent No.: US 8,573,021 B2
(45) Date of Patent: Nov. 5, 2013

(54) METAL BLANK WITH BINDER TRIM COMPONENT AND METHOD

(75) Inventors: John R. Ewolski, Brunswick, OH (US); James W. Walther, Chatham, OH (US); Stephen A. Fetsko, Medina, OH (US)

(73) Assignee: Shiloh Industries, Inc., Valley City, OH (US)

( * ) Notice: Subject to any disclaimer, the term of this patent is extended or adjusted under 35 U.S.C. 154(b) by 0 days.

(21) Appl. No.: 13/274,983

(22) Filed: Oct. 17, 2011

(65) Prior Publication Data

US 2012/0035902 A1 Feb. 9, 2012

Related U.S. Application Data

(62) Division of application No. 12/039,266, filed on Feb. 28, 2008, now Pat. No. 8,062,763.

(60) Provisional application No. 60/903,998, filed on Feb. 28, 2007.

(51) Int. Cl.
*B21D 22/00* (2006.01)

(52) U.S. Cl.
USPC ..... 72/350; 72/379.2; 72/335; 428/577; 700/111

(58) Field of Classification Search
USPC ..... 72/203, 324, 338, 339, 379.2, 350, 351, 72/335
See application file for complete search history.

(56) References Cited

U.S. PATENT DOCUMENTS

| | | | |
|---|---|---|---|
| 1,167,556 | A | 1/1916 | Groehn |
| 1,800,531 | A | 4/1931 | Hothersall |
| 1,898,883 | A | 2/1933 | Matheson |
| 1,900,004 | A | 3/1933 | Whitworth |
| 1,962,279 | A | 6/1934 | Lott |
| 2,177,970 | A | 10/1939 | Wettlaufer |
| 2,335,292 | A | 11/1943 | Messenger |
| 2,387,767 | A | 10/1945 | Nordquist |
| 2,400,590 | A | 5/1946 | Meyerhoefer |

(Continued)

FOREIGN PATENT DOCUMENTS

| | | |
|---|---|---|
| DE | 10120880 A1 | 10/2002 |
| JP | S52-165383 | 12/1977 |

(Continued)

OTHER PUBLICATIONS

Written Opinion & International Search Report for PCT/US08/55279, Jul. 25, 2008, 6 pages.

(Continued)

*Primary Examiner* — Dana Ross
*Assistant Examiner* — Homer Boyer
(74) *Attorney, Agent, or Firm* — Reising Ethington P.C.

(57) ABSTRACT

A metal blank that includes a binder trim component having at least one cut edge with a non-linear section. The creation of the non-linear section simultaneously forms a corresponding section in a binder trim component of an adjacent metal blank so that binder material can be shared therebetween. This reduces the amount of scrap metal, as the binder trim component is subsequently cut off and discarded. Furthermore, the non-linear section can include one or more strategically placed formations, such as projections, recesses, flat sections, etc., that cause it to be non-uniform along its length and to be specifically tailored to the manufacturing requirements of the part being formed.

20 Claims, 4 Drawing Sheets

(56) References Cited

U.S. PATENT DOCUMENTS

| | | | | | |
|---|---|---|---|---|---|
| 2,850,202 | A | | 9/1958 | Schneider et al. | |
| 2,963,783 | A | | 12/1960 | Field | |
| 3,008,441 | A | | 11/1961 | Schonitzer | |
| 3,262,361 | A | | 7/1966 | Langworthy | |
| 3,299,689 | A | | 1/1967 | Dolney et al. | |
| 3,339,333 | A | | 9/1967 | Kovalcik | |
| 3,543,559 | A | * | 12/1970 | Reid et al. | 72/335 |
| 4,106,422 | A | | 8/1978 | Buhrke | |
| 4,119,050 | A | | 10/1978 | Klein | |
| 4,210,041 | A | | 7/1980 | Mitman et al. | |
| 4,244,315 | A | | 1/1981 | Klein | |
| 4,603,571 | A | | 8/1986 | Wessels | |
| 5,128,877 | A | | 7/1992 | Tang | |
| 5,372,027 | A | | 12/1994 | Roper et al. | |
| 5,379,227 | A | | 1/1995 | Tang et al. | |
| 5,390,127 | A | | 2/1995 | Tang et al. | |
| 5,426,337 | A | | 6/1995 | Kobayashi et al. | |
| 5,463,558 | A | | 10/1995 | Tang et al. | |
| 5,572,896 | A | * | 11/1996 | Story | 72/350 |
| 5,600,991 | A | | 2/1997 | Munzen | |
| 5,604,044 | A | * | 2/1997 | McCabe et al. | 428/577 |
| 5,630,337 | A | | 5/1997 | Werth | |
| 5,749,258 | A | | 5/1998 | Werth | |
| 5,901,599 | A | | 5/1999 | Sato et al. | |
| 6,408,516 | B1 | | 6/2002 | Taylor | |
| 6,513,860 | B1 | * | 2/2003 | Ourchane et al. | 296/146.5 |
| 6,588,248 | B1 | | 7/2003 | Bickle et al. | |
| 6,903,475 | B2 | | 6/2005 | Ortt et al. | |
| 7,130,708 | B2 | * | 10/2006 | Wang et al. | 700/111 |
| 7,200,496 | B2 | * | 4/2007 | Liu | 702/35 |
| 7,448,178 | B2 | | 11/2008 | Visone | |
| 2005/0183487 | A1 | * | 8/2005 | Andersson | 72/350 |
| 2005/0200164 | A1 | | 9/2005 | Reed et al. | |

FOREIGN PATENT DOCUMENTS

| | | | |
|---|---|---|---|
| JP | 55103061 | | 8/1980 |
| JP | 6031353 | | 2/1994 |
| JP | H11-057877 | | 3/1999 |
| JP | H11-242707 | | 9/1999 |
| JP | 2003-080321 | | 3/2003 |
| JP | 2004-050253 | | 2/2004 |
| JP | 2004160490 | | 6/2004 |
| JP | 2005-288459 | | 10/2005 |
| JP | 2007-021501 | | 2/2007 |
| SU | 1090473 | A1 | 5/1984 |

OTHER PUBLICATIONS

Office Action for U.S. Appl. No. 12/039,266 dated Dec. 3, 2010 (44 pgs).

Final Office Action for U.S. Appl. No. 12/039,266 dated May 9, 2011 (19 pgs).

Press Technology, Japan, Nikkan Kogyo Shimbun, Ltd., Jan. 1, 2001, pp. 50-52.

Office Action for JP Serial No. 2009-551,846 dated Nov. 8, 2012 (4 pages, English Translation).

* cited by examiner

METAL BLANK WITH BINDER TRIM COMPONENT AND METHOD

REFERENCE TO RELATED APPLICATIONS

This application is a divisional of copending U.S. application Ser. No. 12/039,266 filed Feb. 28, 2008, which claims the benefit of U.S. Provisional Ser. No. 60/903,998 filed on Feb. 28, 2007. The entire contents of which are incorporated herein by reference.

TECHNICAL FIELD

The present invention relates generally to metal blanks, and more particularly, to metal blanks that have a binder trim component and can be used in the automotive industry.

BACKGROUND

In the metal forming industry, sheet metal blanks are oftentimes manufactured with an outer flange that extends around the periphery of the sheet metal blank so that during a subsequent metal forming operation, bead structures formed in the upper and lower die will have blank material to engage and clamp onto. The bead structures usually consist of a male bead formed in a binder ring of one of the die and a female groove formed in a binder ring of the other die, and are designed to mate with one another when the upper and lower dies are brought together under the force of a hydraulic or other type of press. By firmly clamping the outer flange between the opposing bead structures, frictional and deformational forces restrict the outer flange from being pulled into the center of the die during the metal forming process.

Furthermore, the compressional interaction between the bead structures and the outer flange of the sheet metal blank influence the amount of sheet metal material that is drawn into the die. If too little material is drawn in, then it can result in tears or cracks in the formed part; conversely, if too much material is drawn in, the formed part can exhibit wrinkles and/or other surface distortions. After the metal forming process, the outer flange is typically cut or otherwise removed from the formed part and is discarded as scrap material.

SUMMARY

According to one aspect, there is provided a method for designing a binder trim component for a metal blank. The method may comprise the steps of: (a) performing a forming simulation that determines at least one target forming section; (b) performing a nesting simulation that determines at least one target nesting section; (c) utilizing the target forming section and target nesting section to determine an optimum binder trim location for a non-linear section; and (d) developing a non-linear section having a combination of formations specifically designed for the optimum binder trim location and the proposed part.

According to another aspect, there is provided a method for creating a metal blank. The method may comprise the steps of: (a) receiving sheet metal material; (b) creating a metal blank with a binder trim component from the sheet metal material, wherein the binder trim component includes a non-linear section that shares binder material with an adjacent metal blank and controls material flow during a subsequent metal forming operation; and (c) removing the metal blank from the remainder of the sheet metal material.

According to another aspect, there is provided a method for forming a metal blank. The method may comprise the steps of: (a) receiving a metal blank having a binder trim component and a part component located inboard of the binder trim component, the binder trim component includes a formation that influences material flow during a metal forming operation; (b) interposing the metal blank between an upper die and a lower die so the binder trim component can be clamped by the upper and lower die and the part component can be formed into a desired shape having a contoured feature; and (c) performing a metal forming operation while the binder trim component is clamped by the upper and lower die. The formation is located relative to the countered feature and may influence material flow between the formation and the contoured feature during the metal forming operation.

DESCRIPTION OF THE DRAWINGS

A preferred exemplary embodiment of the invention will hereinafter be described in conjunction with the appended drawings, wherein like designations denote like elements, and wherein.

DESCRIPTION OF PREFERRED EMBODIMENT

The metal blank described herein includes a binder trim component having at least one cut edge with a non-linear section that forms a series of projections, recesses, flat sections, and other formations. The creation of this non-linear section simultaneously forms corresponding features in a binder trim component of an adjacent metal blank so that binder material can be shared therebetween. Furthermore, the non-linear section can include one or more strategically placed formations that cause it to be non-uniform along its length such that it is specifically tailored to the manufacturing requirements of the part being formed.

Figure 1:
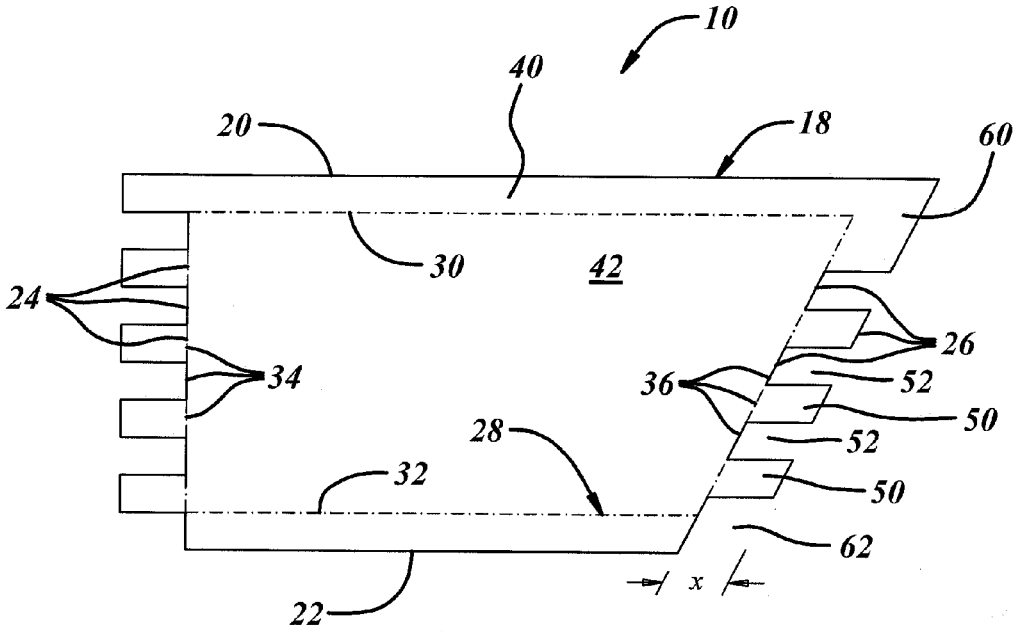
FIG. 1 shows an embodiment of a metal blank having a binder trim component with a non-linear section formed on two sides.

With reference to FIG. 1, there is shown an embodiment of a metal blank 10 that can be used in a wide variety of metal forming operations, such as stamping, drawing, and deep drawing, to create a three-dimensional metal part. Although the following exemplary description is directed to an automotive component, it should be appreciated that the metal blank described herein could also be used as a component in aircraft, railroad, agricultural equipment, and home appliance applications, to name but a few possibilities. Metal blank 10 is preferably made from galvanized cold-formed steel that comes in large coils, however, the composition and form of the metal blank are generally dictated by the requirements of the particular application in which it is used and could vary from those provided above. For example, metal blank 10 could be made from sheet metal material provided in the form of cut or blanked panels, instead of coils. According to this particular embodiment, metal blank 10 is a generally planar sheet metal component and includes an outer periphery 18 having edges 20-26, an inner periphery 28 having edges 30-36, a binder trim component 40 formed therebetween, and a part component 42.

Outer periphery 18 generally constitutes the outer perimeter or border of the metal blank once it has been blanked and, in this particular case, includes four edges 20-26. Edges 20 and 22 are generally elongated parallel edges that extend along the length of metal blank 10 and, according to this particular embodiment, are the manufactured sides of the coil or coil edges that are produced at the steel mill. Edges 34 and 36, on the other hand, generally extend between the manufactured edges 20 and 22 and are the cut sides that are created during the operation that cuts up the coil into individual segments or metal blanks. The term 'cut edge' broadly refers to any edge that is cut, sheared, blanked, trimmed, severed, or otherwise formed when the sheet metal stock is being divided into segments or blanks. Because edge 24 is a cut edge, it has a complementary edge formed on the adjacent metal blank that is located to the left of metal blank 10 on the sheet metal coil, and edge 26 has a complementary edge formed on the adjacent metal blank that is located to the right of metal blank 10 on the coil. In this embodiment, each of the cut edges 24 and 26 includes a non-linear section that forms an alternating series of projections 50 and recesses 52. Although both of the cut edges 24 and 26 are shown here having these projections and recesses, it should be appreciated that the metal blank could be designed such that only one of the cut edges follows this non-linear path. For example, it is possible for the metal blank to include a cut edge 26 having projections and recesses and a straight cut edge 24 that extends between manufactured edges 20 and 22 (see FIG. 2). In fact, any number of different edge combinations are possible, so long as the metal blank has at least one edge of outer periphery 18 that includes a non-linear section, as taught herein.

Figure 2:
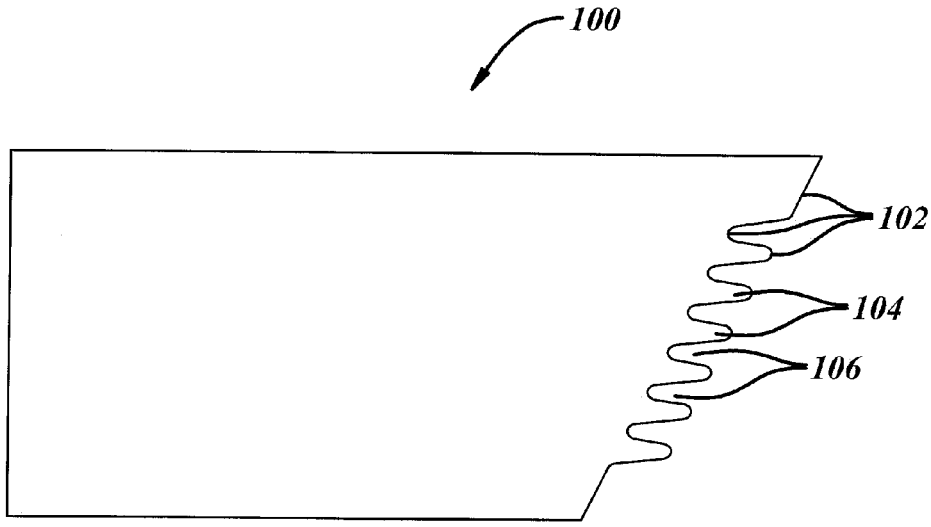
FIG. 2 shows an embodiment of a metal blank having a binder trim component with a non-linear section formed on one side.

Projections 50 and recesses 52 are generally counterparts of one another so that when a projection 50 is formed, a complementary recess 52 is formed on the adjacent metal blank. The width and length dimensions of the different features located along edge 26 are largely determined by the particular requirements of the metal forming operation; that is, the amount of binder material needed to create adequate restraining forces to maintain the metal blank in place and to allow suitable material flow, as will be subsequently explained. In this particular embodiment, the projections are shown in the form of parallelograms, however, it should be appreciated that one of a number of different configurations could be used. For instance, FIG. 2 shows a different embodiment of metal blank 100 having a serpentine edge 102 that includes a sequence of fingerlike projections 104 and recesses 106 having a more tapered shape. As with the previous embodiment, formation of the cut edge 102 causes a corresponding cut edge to be formed in the adjacent metal blank. Again, these are only some of the possibilities for a non-linear edge, as the precise shape, quantity, dimensions, etc. of the projections and recesses can differ from that shown here.

Inner periphery 28 (shown in dotted lines) generally corresponds to a component trim line and forms an inside perimeter of binder trim component 40. The exact positioning of the inner periphery 28 can be dictated by the operational requirements of the subsequent metal forming operation and, according to one embodiment, is generally determined through sophisticated computer modeled algorithms that calculate the amount of binder material that is necessary to form the desired part. Although edges 30 and 32 of the inner periphery are shown here as linear and parallel edges, and edges 34 and 36 are shown as linear and non-parallel edges, it should be appreciated that these exemplary edges could assume various other forms, including non-linear forms, and are not limited to this specific embodiment. For example, although inner periphery 28 is located inboard of binder trim component 40, it is possible for some small section of the binder trim component to extend over the component trim line.

Binder trim component 40 is generally a peripheral component that extends around at least a portion of the metal blank perimeter so that during a metal forming process, upper and lower forming die can be brought together and clamp onto the different sides of the binder trim component. This clamping force around the outside of metal blank 10 prevents the blank from being pulled into the center of the die during the forming process, as is appreciated by those skilled in the art. Binder trim component 40 generally includes the material located between the outer and inner peripheries 18 and 28 and, according to this embodiment, reduces the amount of binder material along cut edges 24 and 26. In conventional metal blanks, cut edge 26 would not include any recesses; thus, the entire amount of material between the outside of cut edge 26 and inner edge 36 (dimension X; typically about 3") would be required as binder for this one metal blank. Likewise, the adjoining metal blank to the right would also require a similar amount of material for its binder component (another 3" of material, resulting in a total of about 6" of binder material for the two metal blanks). The metal blank of the present application, however, has a non-linear section that only uses projections 50 as binder material on that side of the metal blank, as recesses 52 create corresponding projections in the adjacent metal blank. Therefore, a single strip of binder material having a thickness X (which previously would have only been enough binder material for one metal blank) now serves as shared binder material for two adjoining metal blanks and results in a reduction in pitch. This improved utilization of shared binder trim component 40 reduces the amount of scrap material, as the binder component is only used during the metal forming process and is cut off and discarded thereafter.

Part component 42 is located inboard of inner periphery 28, and generally corresponds to the section of metal blank 10 that constitutes the metal part being formed. As will be understood by those skilled in the art, material from binder trim component 40 can and usually will flow to part component 42 during metal forming operations, but the majority of the material that ultimately makes up the resultant part comes from the part component. The part component 42 shown in the drawings is simply provided for purposes of illustration, as the exact shape, size, features, arrangement, etc. of the part component could differ from the exemplary embodiment shown here.

In order to produce the same parts on the same blanking line, it is preferable that the cut edges with non-linear sections be designed to produce adjacent metal blanks that when flipped over or otherwise manipulated are the same. For example, a projection 60 is preferably the same size as a recess 62; this way, when recess 62 is formed, it results in a projection in the adjoining part that is equivalent to projection 60.

Figure 3:
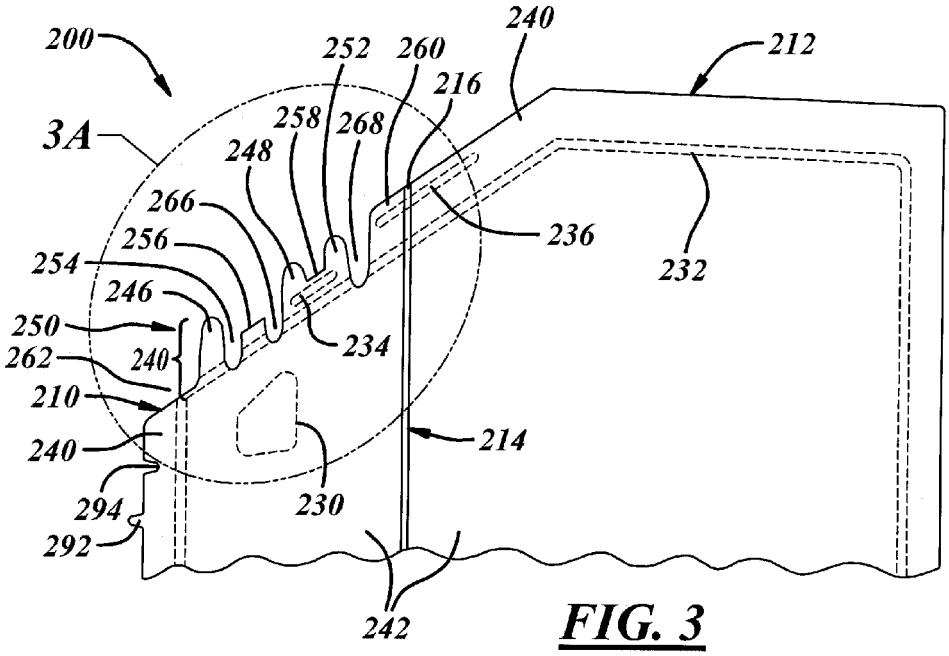
FIG. 3 shows an embodiment of a metal blank assembly that can be used in an automotive door panel, where the metal blank assembly includes a binder trim component with a non-linear section.

Turning now to FIG. 3, there is shown an embodiment of a metal blank assembly 200 which, in a subsequent manufacturing process, can be stamped, drawn, deep drawn, or otherwise formed into a three-dimensional metal part. According to one embodiment, metal blank assembly 200 is particularly well suited for use as a two-piece front inner door panel for an automobile, as will be subsequently explained. Of course, automotive front door panels are only one example of potential applications that could use a metal blank assembly such as this, as numerous other examples also exist, including rear door panels, non-automotive panels, and patchweld panels, to name but a few. According to this embodiment, metal blank assembly 200 is a tailor-welded blank that includes a thick metal blank 210 (similar to metal blanks 10 and 100 in FIGS. 1 and 2) welded to a thin metal blank 212 by a weld seam 214. Thick metal blank 210 can be used to support the door hinges, as door hinges typically require a thicker and hence stronger material to mount to than do other components of the door panel. If this thicker material were used across the entire front inner door panel, then the panel would be considerably heavier and costlier. Thus, thin metal blank 212 is used for the remainder of the front inner door panel; that is, those sections that do not require quite the same strength as the hinge region. Metal blank assembly 200 thus results in a two-piece front inner door panel that achieves its structural objectives, yet does so with less weight, material, and cost. Weld seam 214 can begin or end at welding point 216, depending on the chosen welding process, and is preferably produced by laser welding, mash seam welding, or some other welding technique known to those skilled in the art.

Metal blank assembly 200 can be subsequently formed into a front inner door panel having a number of contoured features, including the exemplary pocket 230 outlined in broken lines. Even though it is envisioned that the front inner door panel will have a number of contoured features, in addition to pocket 230, for purposes of illustration and simplicity only the pocket is shown here. Examples of contoured features that have been omitted from the front inner door panel for purposes of illustration include a cutout for the window, retention features for receiving an interior door module, and a space for housing an electric actuator, to name a few. During an exemplary metal forming operation, male and female bead structures, sometimes referred to as draw beads, located around the perimeter of upper and lower die (not shown here) clamp down on binder trim component 240 so that an elongated bead zone 232 is formed around the periphery of part component 242. One or more additional bead zones 234 and 236 (all of the bead zones are illustrated by broken lines) may be formed during this process as well. The addition of bead zones 234 and 236, as well as their size, configuration, depth, etc., give greater process control by generally controlling the amount of material that is drawn from binder trim component 240 to part component 242 during forming. This control or manipulation of material flow is most acute in the areas adjacent or near the bead zones, and most of the bead zones are preferably located within the boundaries of binder trim component 240. It should be appreciated that while the exemplary bead zone 234 shown here is wholly contained within projections 248, 252 and flat section 258, it is possible for the bead zone to extend beyond these formations and into the adjoining recesses.

Figure 3A:
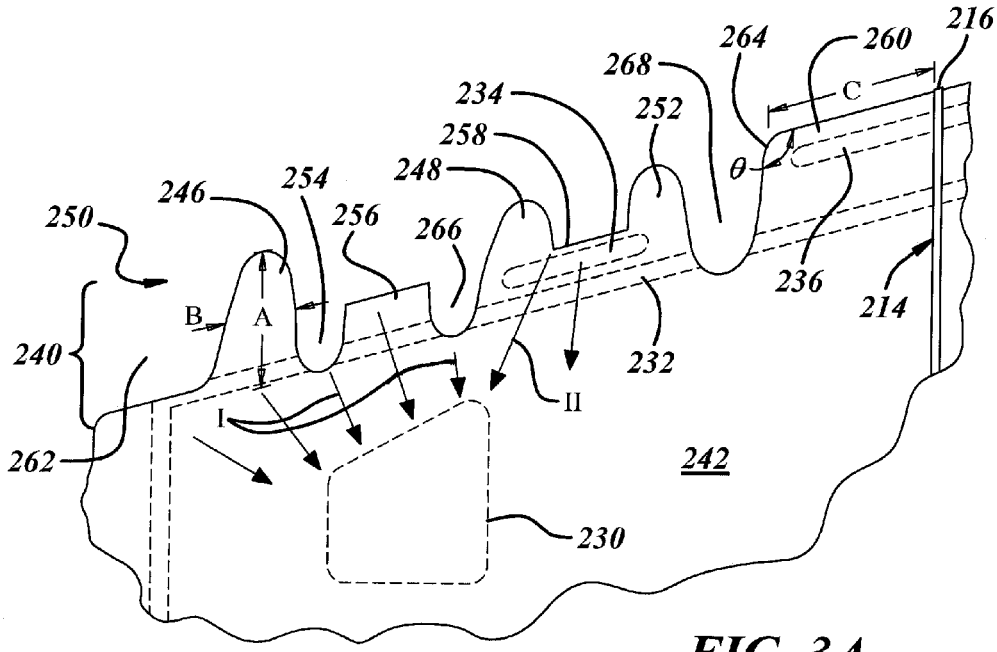
FIG. 3A is an enlarged view of the non-linear section shown in FIG. 3.

According to the embodiment shown here, binder trim component 240 includes a non-linear section 250 having a series of projections 246, 248, 252, 260, recesses 254, 266, 268 and flat sections 256, 258, where the inclusion and placement of these different formations is at least partially based on the desired characteristics of part component 242. For instance, if extra material is needed during the formation of pocket 230, recesses 254 and 266 could be placed along non-linear section 250 so that they are adjacent the pocket. In this example, recesses 254 and 266 have been purposely located near pocket 230 so that material can more easily be drawn into the contours of the pocket when the three-dimensional metal part is being formed. As demonstrated in FIG. 3A, recesses 254 and 266 are located at a specific location along non-linear section 250 so that they are generally aligned with pocket 230 along draw lines I. The draw lines are representative of the general direction of material flow during a subsequent metal forming process, such as a drawing process, and are not meant to precisely detail the exact flow of every metal particle. It could be that the exact and precise flow of metal particles follows a more complex path than that illustratively represented by draw lines I. One potential method for determining draw lines is to use forming simulation software, such as PAM-STAMP offered by ESI Group. In the example above, material around recesses 254 and 266 flows to pocket 230, however, material could flow from other items of non-linear section 250 to pocket 230 and/or other features of part component 242.

Alternatively, if it is desirable to constrain or otherwise limit the amount of material flow in an area adjacent pocket 230, then projections 248 and 252 could be provided so that they are connected by flat section 258 to define a larger projection area. Doing so provides the binder material needed for an additional bead zone 234, which in turn increases the restraining surface and improves the ability to control material flow in the area. In this particular example, flat section 258 is positioned along non-linear section 250 so that a draw line II extending from flat section 258 to pocket 230 passes through two different bead zones; i.e., bead zones 232 and 234. Similar flat sections, as well as other formations, can be selectively formed and placed along non-linear section 250, thus creating a customized non-linear section that is non-uniform along its length and is tailored to the needs of the specific part being formed. Stated differently, non-linear section 250 can include formations (e.g., recesses, projections, flat sections, etc.) that differ from each other in terms of shape and/or size and present different restraining surfaces to the upper and lower die. The different surfaces can result in different amounts of material flowing from binder trim component 240 to part component 242 during a metal forming operation, like drawing. It should be appreciated that non-linear section 250, with its customized arrangement of projections, recesses, flats and other features, enables one to manipulate material flow characteristics of a drawing or other forming process without having to retool the upper and/or lower dies, which can be a rather costly and timely endeavor. Instead, the change can be in binder trim component 240 and not the forming tools.

Projections 246, 248, 252 can be designed and arranged to improve the metal forming characteristics of the metal blank and address the specific needs of the three-dimensional part being formed. For example, it can be desirable for projection 252 to exhibit certain length-to-width relationships that are related to the thickness of the sheet metal from which the projections are formed. For sheet metal stock having a thickness <1.0 mm, it can be desirable for the projections to have a length A and width B that satisfies the relationship: $B \geq A/3$ (dimension 'A' is the length of the projection taken along its longitudinal axis, dimension 'B' is the width of the projection measured at a halfway point; i.e., a point located halfway along the length A). If the projection has a uniform width, then the width dimension can be taken at any point along its length. For sheet metal stock having a thickness 1.0>1.5 mm, inclusive, it can be desirable for the projections to have a length A and width B that satisfies the relationship: $B \geq A/3.5$. For sheet metal stock having a thickness >1.5 mm, it can be desirable for projections to have a length A and width B that satisfies the relationship: $B \geq A/4$. One reason that the above-provided relationships are dependent on the gauge of the sheet metal involves metal forming considerations. The thinner the sheet metal (e.g., <1.0 mm), the easier it is for the projections to tear off during the forming process. Thus, the thicker gauge material (e.g., >1.5 mm) is generally robust enough to allow for thinner or skinnier projections. Although it is possible for non-linear section 250 to include one or more projections that do not adhere to the relationships provided above, such relationships are generally desirable in applications like automobile front inner door panels.

According to another aspect of non-linear section 250, the location of projection 260 and recess 262 is particularly advantageous when it is used in conjunction with a metal blank assembly 200 like that shown here. Projection 260 is located at one end of non-linear section 250 and lies adjacent weld seam 214 in order to improve the integrity of the weld. During some forming operations, weld seam end point 216 can constitute a vulnerable point of the weld seam and can be susceptible to splitting or otherwise losing some of its structural integrity. By locating weld seam end point 216 on projection 260, the point is distanced from the interior sections of the front inner door panel that experience the greatest stresses during the forming process. Thus, any separation occurring at weld seam end point 216 will be part of binder trim component 240, which is subsequently cut off and discarded, and is not part of the final door panel. Contrast that with a scenario where a recess 262, instead of projection 260, is placed along weld seam 214. If a separation from the weld seam end point were to occur, it could extend over the nearby part trim line, possibly resulting in the door panel being scrapped.

The size and shape of projection 260 can affect subsequent metal forming operations. For instance, the width 'C' of projection 260 can be related to the length 'A' of projections 246, 248, 252 and preferably satisfies the relationship: $C \geq A$. If dimension C is too small, then there may not be enough surface for bead structures to contact and maintain the material in and around weld seam 214 during a metal forming operation. Exemplary bead zones 232 and 236 are shown being located in projection 260 and can facilitate proper maintenance of the weld seam area during metal forming operations. According to this embodiment, projection 260 connects with an adjacent recess 268 via a transition point 264, which forms an obtuse angle θ between upper and side edges of the projection. The obtuse angle θ can assist if a blanking process is used to create metal blank 210, as it facilitates easy release of the part after it is blanked and it gives projection 260 a shape that controls material flow during a drawing process without jeopardizing the quality of weld seam 214.

Another advantage resulting from the placement of projection 260 is the increase in binder material along weld seam 214, which enables one or more additional bead zones 236 to be positioned in the area adjacent the weld seam. It has been observed that during forming operations, the areas along the weld seams are more susceptible to failure than other areas of metal blank assembly 200. One possible explanation is that as material is being drawn into the front inner door panel, material from the thick and thin blank components 210, 212 flows differently. Hence, material located on one side of weld seam 214 may be pulling material located on the other side of the weld seam along with it. The addition of bead zone 236 reduces the amount of material drawn and pulled from this area, thereby reducing the likelihood that weld seam 214 will split apart or otherwise be disrupted.

The region along weld seam 214 is not the only area to benefit from the placement of projection 260. The location of recess 262, which is the complement of projection 262 and is formed at the same time, can also improve the formability of metal blank assembly 200. As demonstrated in FIG. 3, recess 262 is generally located at an outer corner of metal blank assembly 200 and can prevent various types of surface distortions, including undesirable puckering. In some instances, forming corners can produce one of a variety of surface defects like puckers and wrinkles due to transverse stresses exerted at the intersection defining the corner. Locating recess 262 at an outer corner of a front inner door panel can reduce some of these stresses and can improve the formability of that part. Of course, the particular effect that a recess can have on forming is largely driven by factors such as the shape and other characteristics of the door panel or other part being formed, for example.

Metal blanks oftentimes include one or more locating features 292, 294 that are located around the outer perimeter of the work piece and help ensure that the metal work piece is properly positioned within the forming die. These locating features can be integrally formed in non-linear section 250 according to one of several different embodiments. For example, it is possible to simply use one or more of the projections 246, 248, 252 and recesses 254, 266, 268 as locating features by providing corresponding locating features in the upper and/or lower forming die. This way, separate locating features would not need to be formed, as the components of non-linear section 250 are being used for this purpose as well. According to a different example, locating features 292, 294 can be formed on non-linear section 250 (example not shown) by forming tabs, indentations, etc. on any combination of the projections, recesses, and flat sections.

Those skilled in the art will appreciate that forming processes such as drawing create sections in the work piece that are weaker than other sections that are drawn to a lesser extent or not drawn at all. These weaker sections usually dictate the gauge and/or quality of the material that must be used, because of the minimum strength needed in the formed part. By manipulating or controlling material flow characteristics through the design of binder trim component 240, and more particularly non-linear section 250, the strength of the weakest parts of the formed part can sometimes be strengthened so that a thinner gauge or lower quality material can be used. For instance, if the area surrounding pocket 230 were determined to be the weakest section of the front inner door panel after it was formed, then non-linear section 250 could be used to strengthen or thicken that pocket. Now that pocket 230, which previously was the weakest link so to speak, has been strengthened, the overall gauge of metal blank 210 or the quality of the metal may be decreased to save cost. It should of course be recognized that binder trim component 240, non-linear section 250, and the various features of the non-linear section could be incorporated into one or more edges of metal blank 210 and/or metal blank 212, or they could be used with a monolithic blank (i.e., a single blank that is not welded to another blank before a metal forming operation). In one embodiment, all of the outer peripheral edges of metal blank assembly 200 have some type of customized non-linear section extending thereon.

Figure 4:
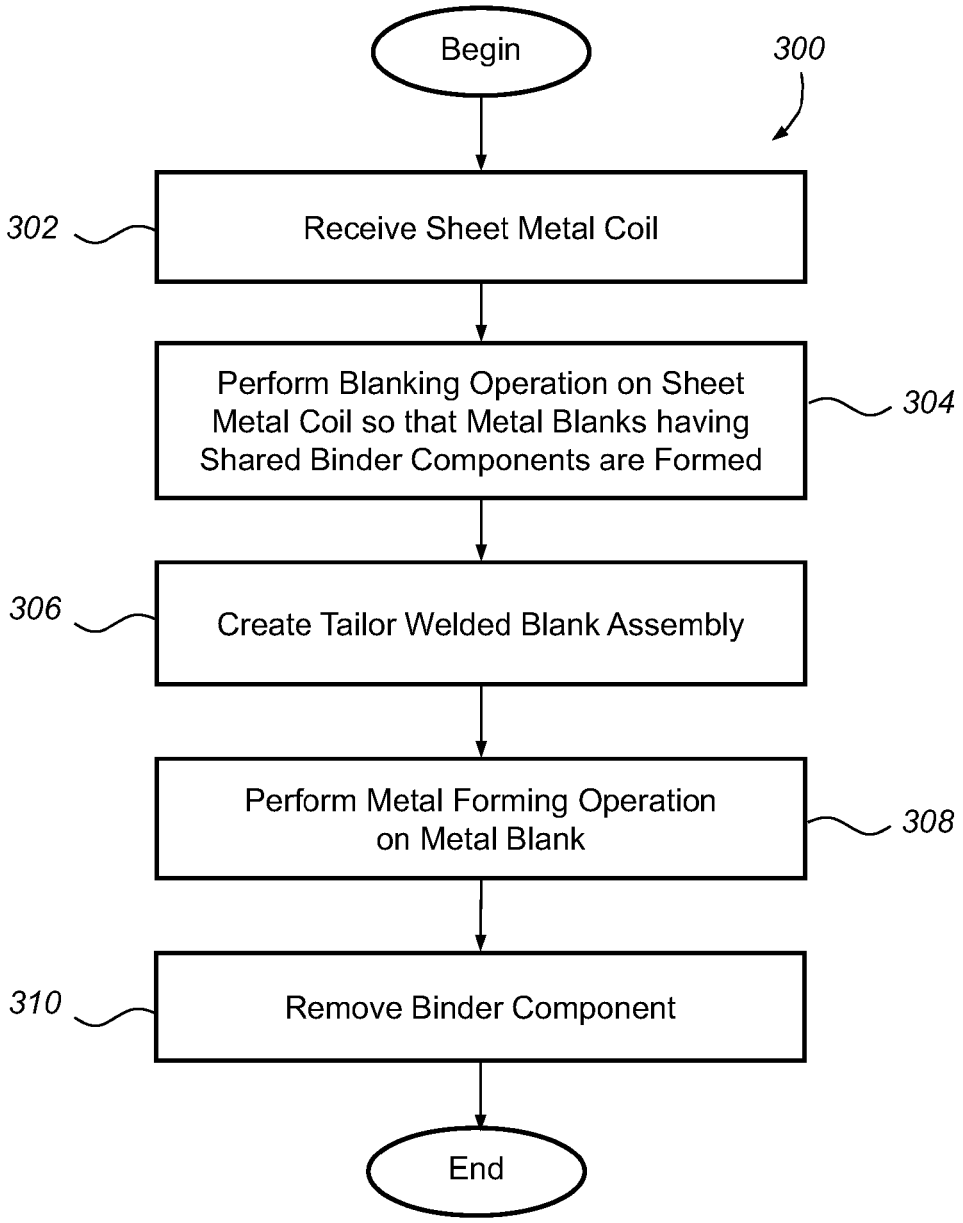
FIG. 4 is a flowchart demonstrating an embodiment of a method for producing a three-dimensional metal part.

Turning now to FIG. 4, there is shown a flowchart demonstrating some of the primary steps of an embodiment 300 of a method for forming a three-dimensional metal structure. First, a sheet metal coil is received and processed by treating, washing and/or slitting the coil, wiping the coil of materials such as oil, and performing any other prerequisite processing steps known to those skilled in the art, step 302. Once the sheet metal coil has been properly processed, it is sent through a blanking operation, step 304, in which a plurality of metal blanks each having an outer periphery similar to the ones shown in FIGS. 1 and 2 are created. As previously explained, the binder components of adjoining metal blanks have corresponding projections and recesses that share material so that the total amount of material needed is reduced. According to one embodiment, each of the individual metal blanks are then laser or otherwise welded to a sheet metal piece of a different thickness or grade so that a tailor-welded blank assembly is created, step 306. This is an optional step, however, as non-tailor-welded blank assemblies having the binder component described above could also be used. Next, the metal blank assembly (be it a tailor- or non-tailor-welded blank assembly) is put through a metal forming operation, step 308, that forms the various contours of the desired part.

According to one stamping operation embodiment, the metal blank is interposed between upper and lower die and is clamped along an outer section which is the binder trim component. One of the two die includes a male component or bead that extends around an outer perimeter of the die and mates with a complementary female component or groove of the other die so that the binder trim component, including the various projections, is trapped therebetween. This creates proper restraining forces on top and bottom sides of the metal blank assembly that prevents it from being drawn into the die cavity too freely (which can cause wrinkles) or too restrictively (which can cause the metal blank to tear or split) during the stamping operation. One of a number of different bead structures could be used, including square, trapezoidal, semi-circular, or other known configurations. Once the sheet metal material has been properly drawn into the shaped cavity of the female die and formed into its desired shape, the part is released and the binder trim component is removed, step 310. The actual method used for removing the binder trim component can vary, but could include techniques such as laser cutting, water jet, die cutting, etc. It should of course be understood that the foregoing description of method steps is simply meant to be an exemplary illustration of some of the primary steps used in such an operation and that many changes to the process could be made. For example, specific deep drawing, stretch forming, press forming, as well as other stamping techniques, for example, could be used.

Figure 5:
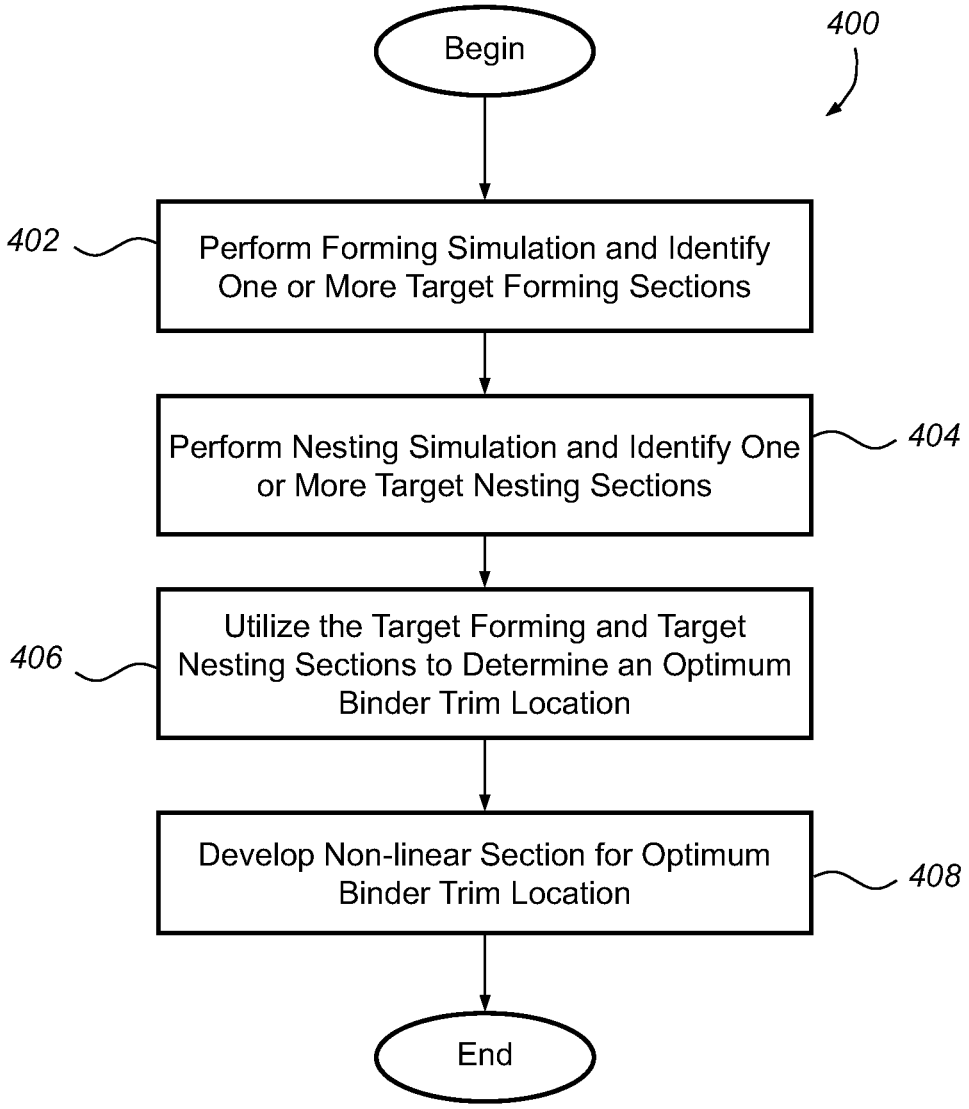
FIG. 5 is a flowchart demonstrating an embodiment of a method for designing a binder trim component of a metal blank.

In FIG. 5, there is shown an embodiment 400 of a method for designing a binder trim component for a metal blank, where the metal blank is used in a subsequent metal forming operation to make a proposed part. Beginning with step 402, the method performs a forming simulation that analyzes a metal forming operation on the proposed part. According to one embodiment, the forming simulation is a computer-based forming simulation that uses non-linear finite element analysis to simulate the metal forming operation and predict common defects such as splits, tears, wrinkles, puckers, springback, material thinning, and the like, as well as the draw-in distances of various sections. As previously mentioned, one suitable program for performing such a simulation is PAM-STAMP sold by ESI Group; however, other programs could certainly be used instead. According to another embodiment, the forming simulation is a physical-based forming simulation, such as a circle-grid analysis, that analyzes material flow by using observing draw-in distances and the like. Among other outputs, step 402 preferably identifies one or more sections of the binder trim component where significant material flow is likely to occur; these sections are referred to as 'target forming sections' and can be determined by, inter alia, their respective draw-in distance. In one embodiment, step 402 even identifies the section or side of the proposed binder trim component where the most draw-in distance is likely to occur.

Next, step 404 performs a nesting simulation that analyzes different arrangements of the proposed part on the sheet metal stock (e.g., coil, flat panels, etc.) in order to determine how to most efficiently arrange the proposed part so that it reduces the amount of wasted material. In one embodiment, the nesting simulation is performed by one of a variety of types of computer-based nesting simulation software. This type of computer-based nesting simulation software can include versions that: allow for flipping, rotating, or otherwise manipulating the sheet metal stock, take into account the limitations of the shearing, cutting or punching tools involved, and can identify defects on the sheet metal stock, to name but a few potential options. One suitable program for performing such a simulation is BlankNest sold by Javelin Technologies; however, other programs could certainly be used instead. In addition to numerous other outputs, it can be desirable for step 404 to identify one or more sections of the binder trim component where binder trim material can be saved through the use of non-linear sections, such as those previously described. These sections are hereafter referred to as 'target nesting sections'. If no target nesting sections are identified, it may be necessary to re-perform the nesting simulation so that the proposed parts are rotated or arranged differently on the sheet metal stock.

Step 406 then utilizes the target forming and target nesting sections identified above to determine an optimum binder trim location for a non-linear section, such as non-linear section 250. Thus, the placement of the optimum binder trim location is mindful of both metal forming considerations (i.e., target forming sections) and scrap metal reduction considerations (i.e., target nesting sections). Put differently, method 400 determines the best location around the binder trim component for a non-linear section based on metal forming considerations, determines the best location around the binder trim component for a non-linear section based on scrap metal reduction considerations, and then looks for a common location that addresses or satisfies both concerns; this common or overlapped location corresponds to the optimum binder trim location. In some instances, the section of the binder trim component where the most material is likely to flow matches up with the section where the most scrap metal savings can be enjoyed; this common section is the most likely location for a non-linear section. In other instances, it may be that the binder trim component section having the second or third most material movement corresponds to the section having the most scrap metal savings. In this case, step 406 can consider all of the factors and make a decision based on the totality of the circumstances, including metal forming considerations, scrap metal saving considerations, and others.

Once the optimum binder trim location is determined, step 408 develops a non-linear section having a combination of projections, recesses, flat sections, and other formations that are specifically designed for the optimum binder trim location and the proposed part. As explained above, formations like recesses can be added to the non-linear section near pockets, embossments, flat sections, and other part features to promote material flow in the area; formations like projections can be added to restrict material flow by providing binder material for the upper and lower die to clamp down on; and formations such as flat sections can be inserted along the non-linear section to accommodate draw beads, lock beads, and other types of features that even further limit material flow during drawing operations and the like. The precise placement, size, shape, number, etc. of these formations is largely driven by factors such as the requirements of the proposed part and the optimum binder trim location.

It is to be understood that the foregoing description is not a definition of the invention itself, but is a description of one or more preferred exemplary embodiments of the invention. The invention is not limited to the particular embodiment(s) disclosed herein. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the particular methods described in conjunction with FIGS. 4 and 5 are only exemplary sequences of steps, as numerous other sequences could alternatively be used, including those with additional steps, omitted steps, and/or different steps. It is possible to form metal blanks with the binder trim component described above from metal panels instead of from metal coils. Also, the non-linear sections described above could be used on interior cut edges, not just the exterior cut edges shown in the exemplary embodiments. All such other embodiments, changes, and modifications are intended to come within the scope of the appended claims.

As used in this specification and claims, the terms "for example", "e.g.," "for instance", "like", and "such as," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A method for creating a metal blank, comprising the steps of:

(a) receiving sheet metal material;

(b) creating a metal blank with a binder trim component from the sheet metal material, wherein the binder trim component includes a non-linear section that shares binder material with an adjacent metal blank to reduce scrap metal and includes at least one strategically placed formation to control material flow during a subsequent metal forming operation, and the strategically placed formation causes the non-linear section to be non-uniform along at least a portion of its length; and (c) removing the metal blank from the remainder of the sheet metal material.

2. The method of claim 1, wherein step (a) further comprises receiving sheet metal material in the form of a metal coil; and step (b) further comprises creating a plurality of metal blanks from the metal coil, wherein each of the plurality of metal blanks includes an outer periphery having at least one edge that is a manufactured edge of the metal coil and at least one edge that is a cut edge of the metal coil.

3. The method of claim 2, wherein step (b) further comprises creating a first metal blank with a first cut edge and a second metal blank with a second cut edge, the first and second cut edges complement one another so that the first and second metal blanks share binder material.

4. The method of claim 1, wherein the non-linear section includes at least one strategically placed formation in the form of a projection that restrains material flow during the subsequent metal forming operation.

5. The method of claim 1, wherein the non-linear section includes at least one strategically placed formation in the form of a flat section that restrains material flow during the subsequent metal forming operation.

6. The method of claim 1, wherein the non-linear section includes at least one strategically placed formation in the form of a recess that promotes material flow during the subsequent metal forming operation.

7. The method of claim 1, wherein the non-linear section includes at least one strategically placed formation that is positioned to control material flow between the binder trim component and a contoured feature formed during the subsequent metal forming operation.

8. The method of claim 1, wherein the non-linear section includes at least one formation that forms a bead zone and controls material flow between the binder trim component and a part component during the subsequent metal forming operation.

9. The method of claim 1, wherein the non-linear section includes strategically placed formations in the forms of a projection and a recess that are complementary in shape to one another, the projection is located at a first end of the non-linear section and the recess is located at a second opposite end of the non-linear section.

10. The method of claim 1, wherein step (b) further comprises forming a projection in a first metal blank and simultaneously forming a recess in a second metal blank, the first and second metal blanks are adjacent one another and the projection and recess complement one another.

11. The method of claim 1, further comprising the step of:

(d) welding the metal blank to an additional sheet metal piece of a different thickness or grade to create a tailor-welded blank assembly.

12. The method of claim 1, further comprising the step of:

(d) performing a metal forming operation on the metal blank where the non-linear section controls material flow between the binder trim component and a part component.

13. A method for forming a metal blank, comprising the steps of:

(a) receiving a metal blank having a binder trim component and a part component located inboard of the binder trim component, the binder trim component includes at least one strategically placed formation that is located relative to a countered feature in the part component and influences material flow during a metal forming operation;

(b) interposing the metal blank between an upper die and a lower die so the binder trim component can be clamped by the upper and lower die and the part component can be formed into a desired shape having a contoured feature; and (c) performing a metal forming operation while the binder trim component is clamped by the upper and lower die, wherein the the at least one strategically placed formation influences material flow between the formation and the contoured feature during the metal forming operation.

14. The method of claim 13, wherein step (a) further comprises receiving a metal blank having a binder trim component that includes at least one strategically placed formation in the form of a projection; and step (c) further comprises performing a metal forming operation, wherein the projection is located adjacent the contoured feature and restrains material flow to the contoured feature during the metal forming operation.

15. The method of claim 13, wherein step (a) further comprises receiving a metal blank having a binder trim component that includes at least one strategically placed formation in the form of a flat section; and step (c) further comprises performing a metal forming operation, wherein the flat section is located adjacent the contoured feature and restrains material flow to the contoured feature during the metal forming operation.

16. The method of claim 13, wherein step (a) further comprises receiving a metal blank having a binder trim component that includes at least one strategically placed formation in the form of a recess; and step (c) further comprises performing a metal forming operation, wherein the recess is located adjacent the contoured feature and promotes material flow to the contoured feature during the metal forming operation.

17. The method of claim 13, wherein step (a) further comprises receiving a metal blank having a binder trim component that includes a first strategically placed formation and a second strategically placed formation; and step (c) further comprises performing a metal forming operation, wherein the first formation restrains material flow to the part component during the metal forming operation and the second formation promotes material flow to the part component during the metal forming operation.

18. The method of claim 13, wherein step (c) further comprises performing the metal forming operation so that material flows from the at least one strategically placed formation to the contoured feature along one or more draw lines that cross at least one bead zone.

19. The method of claim 13, wherein the metal forming operation is either a stamping operation or a drawing operation.

20. The method of claim 1, further comprising the step of:

(d) removing the binder trim component from the part component.

* * * * *

UNITED STATES PATENT AND TRADEMARK OFFICE

CERTIFICATE OF CORRECTION

PATENT NO. : 8,573,021 B2
APPLICATION NO. : 13/274983
DATED : November 5, 2013
INVENTOR(S) : John R. Ewolski et al.

It is certified that error appears in the above-identified patent and that said Letters Patent is hereby corrected as shown below:

In the Claims

Column 12, claim 13 (c), line 46, after "Wherein" delete "the" second occurrence Signed and Sealed this
Twenty-fourth Day of June, 2014

Michelle K. Lee

Michelle K. Lee
*Deputy Director of the United States Patent and Trademark Office*